United States Patent [19]

Finch et al.

[11] 4,164,635

[45] Aug. 14, 1979

[54] WALL SWITCH TIMER

[75] Inventors: David A. Finch, Ann Arbor; Charles M. Smillie, III, Orchard Lake, both of Mich.

[73] Assignee: Time Systems, Inc., Ferndale, Mich.

[21] Appl. No.: 888,888

[22] Filed: Mar. 22, 1978

[51] Int. Cl.[2] ..... H01H 7/00; H01H 43/00

[52] U.S. Cl. ..... 200/33 R; 200/34; 200/39 R; 267/114

[58] Field of Search ..... 200/33 R, 33 B, 34, 200/39 R, 330, 337; 267/113, 114

[56] References Cited

U.S. PATENT DOCUMENTS 2,590,840 4/1952 Clayton ..... 200/34

*Primary Examiner*—James R. Scott

*Attorney, Agent, or Firm*—Cullen, Sloman, Cantor, Grauer, Scott & Rutherford

[57] ABSTRACT

The timer is adapted to be attached to a toggle light switch and comprises a body having a trip slide mounted in the body, with the slide having means for receiving and engaging the switch handle for tripping same to operate the lights. Spring means is provided in the body engageable with the slide for urging the slide to turn the lights off. When the slide is moved to compress the spring the lights are turned on. With the lights on, a latch carried by the slide engages the body to maintain the slide latched with the spring compressed. Fluid responsive timing means, located within the body, is engageable with the latch to operate and release the latch from engagement with the body after expiration of a predetermined time interval. Thereafter the compressed spring means moves the slide in a direction to trip the switch handle, thus turning the lights off.

23 Claims, 6 Drawing Figures

FIG. 1
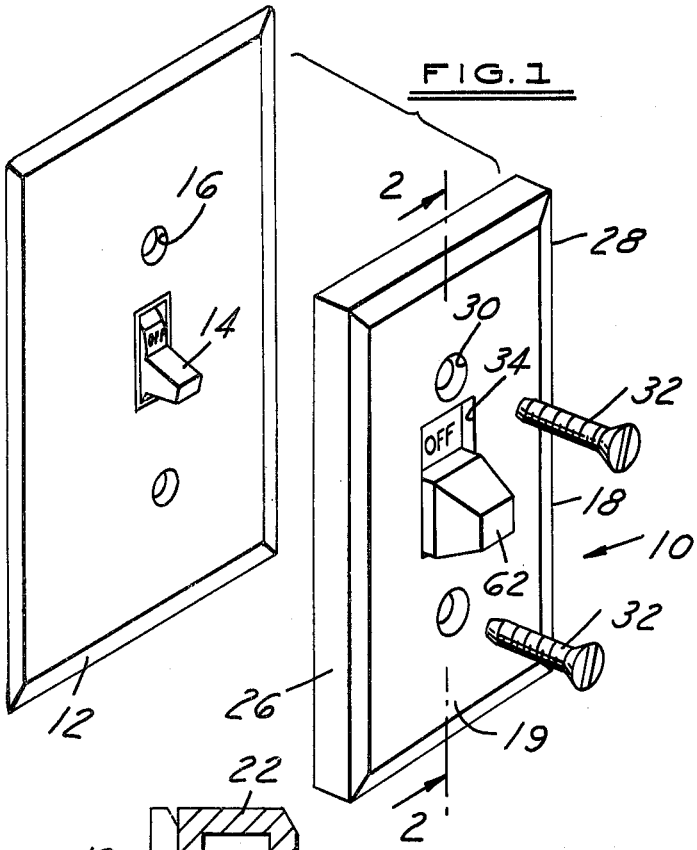
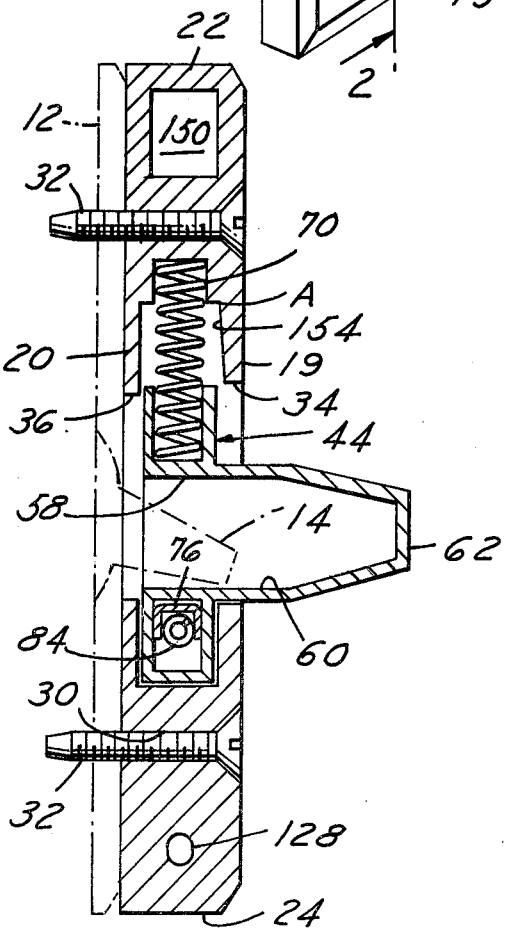
FIG. 2
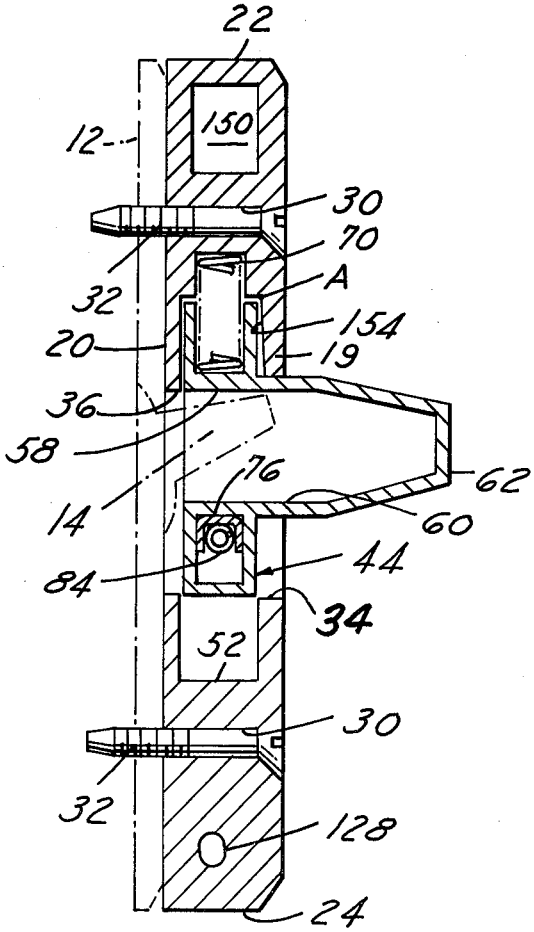
FIG. 4

WALL SWITCH TIMER

BACKGROUND OF THE PRESENT INVENTION

1. Field of the Invention

This invention relates generally to timing devices for automatically operating switches of various types used in different industries or in various apparatuses, weapons or the like and relates more particularly to an improved fluid responsive control for operating toggle switches of the type ordinarily used in building or house lighting circuits after the lapse of a predetermined time interval.

2. Description of the Prior Art

The prior art illustrates the concept of providing a portable switch mechanism to be attached to a normal toggle light switch and which is operative to turn the lights off. The pertinent prior art known to the Applicants is as follows: U.S. Pat. No. 2,937,247 of May 17, 1960 to Lawrence J. Laviana et al.; U.S. Pat. No. 3,179,758 of Apr. 20, 1965 to Robert Trock; U.S. Pat. No. 3,740,680 of June 19, 1973 to Carl Schneidinger; U.S. Pat. No. 3,818,156 of June 18, 1974 to Anthony A. Augustyniak; U.S. Pat. No. 3,985,982 of Oct. 12, 1976 to Carl Schneidinger; and U.S. Pat No. 4,021,626 of May 3, 1977 Robert R. Becker.

The prior art timers include mechanical as well as electromechanical devices. The mechanical timers are rather complex and consist of complicated cam and/or lever arrangements which in use have not proven successful. The electromechanical devices have not had total acceptance in the marketplace. When such a device is installed by a typical user, electrical connections are required thus rendering same unattractive.

SUMMARY OF THE PRESENT INVENTION

There is a constantly increasing public demand and or requirement to save electrical energy. The policy of the United States Government and of the several states is to encourage the citizenry to save energy by practicing methods of electrical conservation.

Accordingly, it is a feature of the present invention to provide a fluid responsive timing device which is particularly suited for mounting over a conventional switch plate and which can be used to turn the electrical switch either on or off after the lapse of a timed interval.

A further feature of the present invention is to provide a toggle switch fluid responsive timer that is easily installed as an attachment for standard toggle switches by utilizing the standard switch wall plate mounting fixtures.

A still further feature of the present invention is to provide a hydraulic-pneumatic timing device which requires a mechanical input to turn on the light switch and which returns a mechanical output to turn off the light switch upon the expiration of a certain time period.

Another feature of the present invention is to provide a timing device comprising a hollow body, a trip slide mounted in the body and movable along an axis between first and second positions, with the trip slide having means adapted for receiving and engaging an operating arm for tripping same as a result of the movement of the trip slide, spring means in the body engageable with the trip slide for urging same towards the first position, and with the spring means being compressed by the trip slide when the latter is moved to the second position, a latch carried by the trip slide and engageable with the body to maintain the trip slide in the second position with the spring means compressed, and fluid responsive timing means located within the body and engageable with the latch to operate and release the latch from engagement with the body after the expiration of a predetermined time interval thereby permitting the compressed spring means to move the trip slide to the first position thus tripping the operating arm.

Still another feature of the present invention is to provide a timing device of the aforementioned type wherein the body includes an abutment at one side of and spaced from the axis and the trip slide, means mounting the trip slide in the body for rotation in a direction perpendicular to the axis from the second position to a third position where the spring means remains compressed and the trip slide engages the abutment, and with the engagement of the slide and the abutment overriding the effectiveness of the fluid responsive timing means and preventing same from controlling the trip slide.

A further feature of the present invention is to provide a timing device of the aforementioned type wherein resilient means is carried by the trip slide for biasing the latch towards latching engagement with the body.

A still further feature of the present invention is to provide a timing device of the aforementioned type wherein the fluid responsive timing means includes a fluid actuator abutting the latch, a pressurized fluid reservoir, a fluid passage connecting the reservoir to the actuator, and adjustable valve means interposed in the passage between the reservoir and the actuator for controlling the rate of fluid flow from the reservoir to the fluid actuator for energizing same.

Another feature of the present invention is to provide a timing device of the aforementioned type wherein the fluid actuator is in the form of a piston-cylinder device, with the piston having a rod at one side which engages the latch, and an expandable diaphragm engaging the other side of the piston and being subjected to the fluid entering the actuator so as to control the rate of movement of the piston and piston rod.

Still another feature of the present invention is to provide a timing device of the aforementioned type wherein compressed air is provided in the body to pressurize the fluid reservoir.

A further feature of the present invention is to provide a timing device of the aforementioned type wherein the fluid responsive timing means comprises a closed hydraulic system located within the body having a pressurized hydraulic reservoir, an actuator for operating the latch, and adjustable valve means located between the reservoir and the actuator for controlling hydraulic flow between the actuator and the reservoir.

A still further feature of the present invention is to provide a timing device of the aforementioned type wherein the valve means includes an adjustable valve element which controls the rate of fluid flow from the reservoir through an orifice into the actuator and a one-way check valve which opens when the hydraulic fluid is ejected from the actuator when the trip slide is moved to the first position by the spring means.

Another feature of the present invention is to provide a timing device of the aforementioned type wherein the adjustable valve element is made from a compressible open cell plastic foam material.

Still another feature of the present invention is to provide a timing device of the aforementioned type wherein the fluid responsive timing means is simple in construction, efficient in operation, economical to manufacture and is easy to install.

BRIEF DESCRIPTION OF THE DRAWINGS

FIG. 1 is a perspective view of the fluid responsive timing device and illustrating the manner of securing the timing device to a conventional electric light toggle switch;

FIG. 2 is a vertical sectional view through the timing device taken generally on the line 2—2 of FIG. 1, with the toggle switch in an off position, the trip slide unlatched and the spring released;

FIG. 4 is a vertical sectional view through the timing device as installed taken on the line 4—4 of FIG. 3 and illustrating the toggle switch in an on position, with the trip slide latched and the spring compressed as illustrated in FIG. 3;

DESCRIPTION OF THE PREFERRED EMBODIMENT

Figure 3:
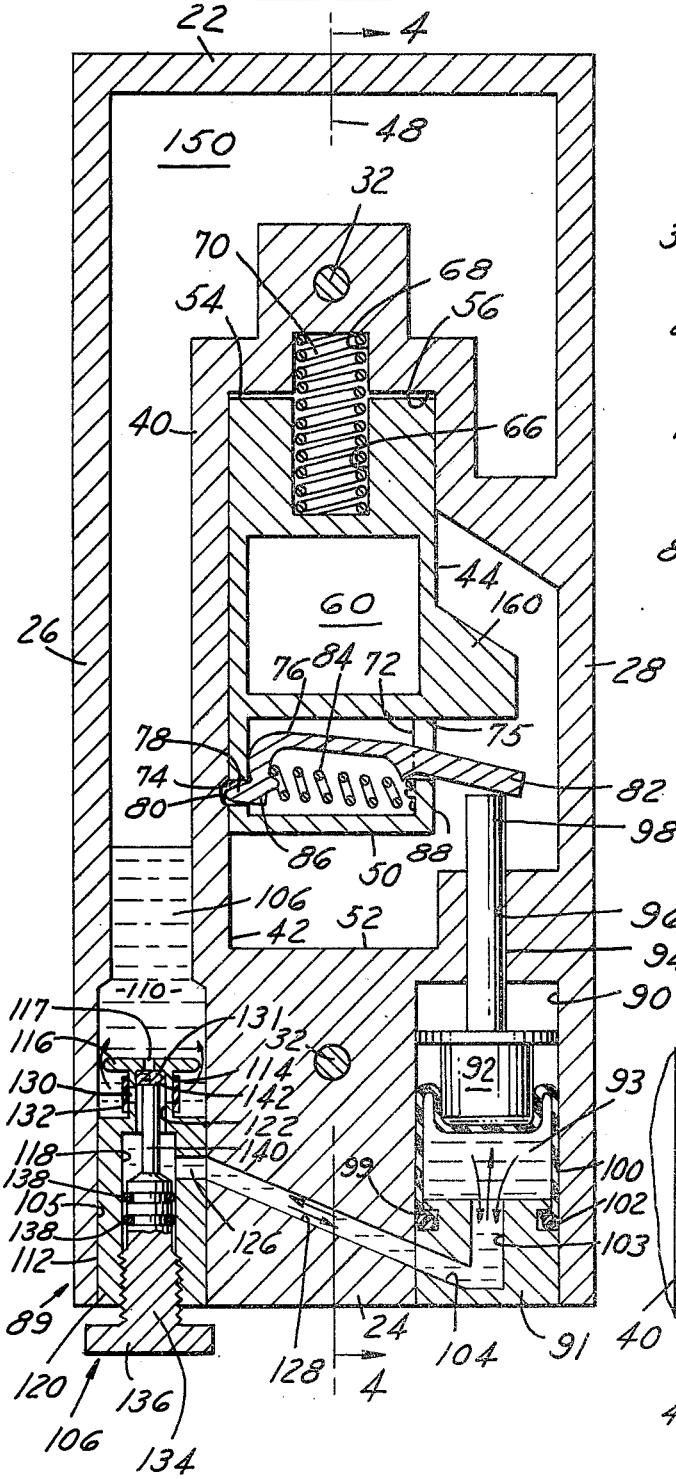
FIG. 3 is a vertical sectional view through the timing device as installed and taken in a plane parallel to the wall switch plate, with the electric toggle switch being on, the trip slide latched and the spring compressed.

The fluid responsive timing device of the present invention is designated by the numeral 10 and is adapted to be mounted over the usual wall switch cover plate 12 through which the conventional toggle switch operating handle 14 extends (FIG. 1) as is well known in the art. The cover plate 12 has the usual pair of screw apertures 16 for mounting same to the electrical receptacle. The usual mounting screws are removed at the time the timing device 10 is mounted thereon.

The timing device 10 comprises a generally closed hollow body 18 of rectangular configuration somewhat like the rectangular shape and cofiguration of the conventional wall plate 12. The body 18 is generally hollow and has a front wall 19, a back wall 20, a top wall 22, a bottom wall 24 and a pair of side walls 26 and 28. The walls 22, 24, 26, and 28 form a generally rectangular type frame. Mounting holes 30 extend laterally through the body 18 and overlie the apertures 16. Bolts or screws 32 secure the timing device 10 to the plate 12. The body 18 is made from an injection molded plastic material and functions as the carrier for all other system components to be subsequently described.

The front wall 19 is provided with a generally centrally located opening 34 while the back wall 20 is provided with a centrally located opening 36. The openings 34 and 36 are of rectangular configuration (FIG. 1). The toggle switch operating handle 14 extends through opening 36 into the body 18 as will subsequently appear.

The body 18 has in the interior thereof internal wall means 40 which divides same into a number of cavities, recesses, or compartments. First, the internal wall means 40 cooperates with front and back walls 19 and 20 to form a chamber 42 in which is movable an elongated trip slide or slider 44. Slider 44 is movable along a longitudinal axis 48 (FIG. 3) between first and second limiting positions.

The slider 44 has a lower end surface 50 which is adapted to abut the internal body surface 52 when the slider 44 is in the first limiting position (FIG. 2), which corresponds to the off position of the toggle switch operating handle 14. The slider 44 has an upper end surface 54 which is adapted to abut the internal body surface 56 of the internal wall means 40, as shown in FIG. 3, when the slider is in the second limiting position, which corresponds to the on position of the toggle switch operating handle 14.

Figure 5:
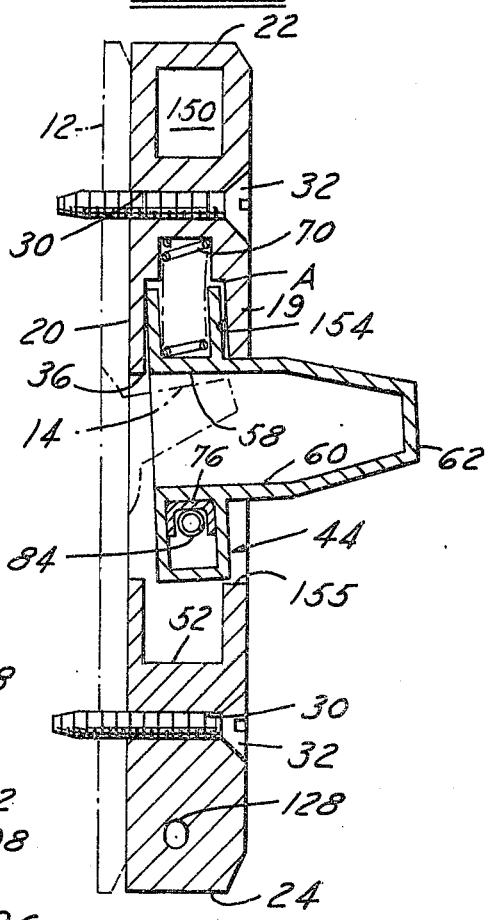
FIG. 5 is a vertical sectional view through the timing device as installed and illustrating the toggle switch in an on position, with the trip slide member unlatched but rotated to a position which renders the fluid responsive timing means ineffective.

The trip slide or slider 44 has an opening 58 in one side thereof which leads into a generally hollow chamber 60 formed in the slide 44. The toggle switch operating arm or handle 14 extends through opening 58 into chamber 60. The trip slide 44 includes a hollow operating arm portion 62 projecting outwardly from the body 18 through the opening 34 provided in the front wall 19 as shown in FIGS. 2, 4, and 5. The hollow operating arm portion 62 overlies chamber 60.

The slider or trip slide 44 is made from an injection molded plastic material. The slider 44 functions as the force input and output element of the system. It moves along the major axis 48 from the position of FIG. 4 to the position of FIG. 5 and is free to rotate about an axis perpendicular to the major axis 48. Such rotation occurs when slide 44 is at the termination point of the input motion as will be subsequently described. The slider 44 as noted previously entraps the toggle switch operating handle 14 and thus transmits motion to the handle 14 to turn the lights on or off.

The trip slide or slider 44 is provided with a cavity 66 which cooperates with a cavity 68 provided in the opposing internal wall means 40 as best illustrated in FIG. 3. The aligned cavities 66, 68 form a chamber for the resilient means or main coil spring 70. The slider 44 thus locates the main spring 70 which is made from spring coil steel. The spring 70 functions as the force storing element of the system for output and time delay reset as will subsequently appear.

The slider 44 further includes a cavity 72. A latch opening 74 is provided in one wall of the slider 44. A slot 75 is formed in another wall of slider 44. Located in the cavity 72 is an elongated latch lever 76. The lever 76 has a detent or keeper element 78 which is adapted to be moved through the opening 74 into a locking recess 80 formed in the opposing internal wall means 40. The handle end 82 of lever 76 extends outwardly from cavity 72 through slot 75 as shown in FIG. 3. The latch lever 76 is made from an injection molded nylon. It functions to lock the slider 44 in a position with the spring 70 compressed, thereby storing energy in the spring as shown by FIG. 3. A coil latch spring 84 is interposed between the head 86 of latch lever 76 and the slider wall 88 to bias the latch lever 76 into latching engagement with recess 80 as shown in FIG. 3. The latch lever 76 is rotated by means to be subsequently described to disengage the lever detent 76 from the recess 80 in the body. The lever 76 will also translate to disengage the detent 78 from recess 80 when a force, large enough to override the latch spring 84, is exerted on the slider or trip slide 44.

The latch spring 84 is made from spring coil steel. It functions to locate the latch lever 76 and balances the main spring 70 through the mechanical advantage of the latch lever 76.

When the slider or trip slide 44 is moved along the axis 48, as an example from the lower limiting position or abutment 52 to the upper limiting position illustrated in FIG. 3, the trip slide 44 moves against the spring 70 and compresses same. As a result thereof, the toggle switch operating arm 14 trapped within chamber 60 of the trip slide 44 is tripped, thereby turning on the lights.

A closed hydro-pneumatic circuit or system 89 (FIG. 3) is provided within the interior of the body 18 generally adjacent the lower portion thereof. The hydro-pneumatic system 89 is designed to operate and release the latch lever 76 from the recess 80 provided in the internal wall means 40. Such system 89 directs fluid to an actuator which operates and releases the lever or latch 76 after the expiration of a predetermined interval which depends upon the time it takes for the hydraulic fluid to flow across a metered orifice.

The body 18 is provided with a longitudinal bore 90 which extends through the bottom wall 24 as shown in FIG. 3. A diaphragm carrier 91 is inserted in the outer end of the bore 90 and cooperates with the remaining portion of the bore 90 to form a cylinder 93 in which is located a piston 92. The upper side of the piston 92 is provided with an elongated piston rod or stem 94 which extends through an opening 96 provided in an internal wall of the body 18. The piston rod 94 has an end portion 98 abutting the handle portion 82 of the lever 76 as noted in FIG. 3. The cylinder 93, piston 92 and piston rod 94 form an actuator or piston-cylinder device or assembly.

The diaphragm carrier 91 has an annular groove 99 in which the outer periphery of the diaphragm 100 is located. A seal ring 102 maintains the outer periphery of the diaphragm 100 in the diaphragm carrier 91. The diaphragm carrier 91 has a vertical passage 103 which intersects the cylinder 93 beneath the diaphragm 100 and a laterally and upwardly extending passage 104. The diaphragm carrier 91 is made from an injection molded plastic material and functions to locate the diaphragm 100 and transmit fluid to and from the diaphragm 100.

The body 18 further includes an elongated bore 105 which extends through the bottom wall 24 thereof generally parallel to bore 90. Adjustable valve means 106 is inserted in bore 105 and closes the outer end of the bore 015 adjacent the bottom wall 24 as shown in FIG. 3. Located in body 18 above the adjustable valve means 106 is a fluid reservoir 108 containing hydraulic fluid 110. The hydraulic fluid selected is a high viscosity fluid which functions to limit the flow rate.

The adjustable valve means 106 is located in the outer end of the bore 105 and closes same as best illustrated in FIG. 3. It includes a generally tubular-like body 112 of cylindrical configuration throughout substantially its longitudinal extent. The valve body 112 is made from brass. The valve body 112 has a head portion 114 of reduced diameter on the inner end thereof terminating in an annular disc-like element 116 which has a diameter less than the diameter of the bore 105. The main valve body 112 is provided with an internal chamber 118, the outer end of which 120 is threaded. The chamber 118 communicates with a passage 122 provided in the head portion 114 of the valve body 112. The disc 116 has a centrally located port 117 communicating with the passage 122 provided in the head portion 114.

The valve body 112 also includes a radially extending port 126 which is connected to the passage 104 provided in the diaphragm carrier 91 by means of a passage or conduit 128 provided in the body 18.

The head portion 114 includes a plurality of radially extending ports or openings 130 around which is located an annular rubber valve element 132 which overlies the ports 130 and serves as a one way check valve. The purpose of the check valve element 132 is to open to direct return hydraulic fluid from cylinder 93 to the reservoir 108 located above the valve means 106 as illustrated in FIG. 3.

An open cell plastic foam element or restrictor 131 is interposed in the passage 122 and controls or meters the flow through the port 117 and through the pores provided in the element or restrictor 131. An elongated valve element 134 made from brass having a knob 136 is screw threaded into the valve body 112. A pair of O rings 138 are carried by the valve element 134 and engage the wall of the chamber 118 of the valve body 112 to prevent flow or leakage across the valve element 134 and to seal the system from the atmosphere. The inner end of the valve element 134 is provided with an elongated stem 140 which is spaced from the wall of chamber 118 and passage 122 to permit flow of hydraulic fluid therethrough as will subsequently appear. The valve element 134 includes an abutment surface 142 which engages the open cell compressible foam element 131 and is adapted to compress same thus changing the size of the pores or cells or orifices therein. Rotation of the valve element 134 is effective to adjust the size of the multiple orifices or thickness of the element or restrictor 131 thereby controlling the rate of flow across the valve means 106 to the cylinder 93. Rotation of the needle valve 134 in one direction increases the rate of flow while rotation of the needle valve in the opposite direction decreases the rate of flow.

The internal wall means 40 not only define the slider chamber 42 but also is spaced from the top wall 22 and the side walls 26 and 28 to form a chamber or reservoir 150 above the fluid reservoir 108 in which is located air under pressure. The purpose of the compressed air is to force the viscous fluid or hydraulic fluid from the reservoir 108 through the valve means 106, passage 128 into the cylinder 93 to react against the diaphragm 100 which in turn moves the piston 92 and rod 94 in a direction to rotate and disengage the lever 76 from the recess 80 provided in the internal wall means 40. The compressed air reservoir 150 contains the pressure, which in turn drives the timing system and supplies the force to release the output sub-system.

The piston and rod assembly 92 and 94 respectively are made from an injection molded plastic material. The purpose of the piston and rod assembly is to transmit force and motion from the diaphragm 100 to the latch lever 76. The diaphragm 100 is either dipped or formed from an injection molded rubber material. The purpose of the diaphragm 100 is to entrap the working fluid in the cylinder 93 beneath the piston 92 and to transmit the force and motion to the piston 92 and rod 96. The diaphragm 100 is of a rolling type. The seal ring 102 is made from spring steel and functions to hold and seal the diaphragm 100.

The inner or rear surface 154 of the front wall 19 above the front opening 34 is tapered downwardly and outwardly starting at area or point A and forms an abutment as shown in FIGS. 2, 4 and 5. The purpose of the inclined surface or abutment 154 is to permit the slider 44 when nearing the second limiting position of FIG. 2 to be rotated about point A so as to swing the slider 44 partially out of the body 18 into engagement with abutment 154 and the surface 155 of wall 19 defining the bottom of opening 34. This defines or forms a third position where the spring means 70 is compressed and the latch 76 is in a released position.

As a result of such rotation of the trip slide or slider 44 about point A, the bottom surface 50 thereof is moved through the front opening 34 to engage surface 155 of the front wall 19 as shown in FIG. 5. When in such position, which is referred to herein as the third position, the light switch is on and the spring means 70 is compressed. By locking the slider 44 in the third position of FIG. 5, the effectiveness of the fluid responsive timing means 106 is overridden whereby it is impossible for the timing means 106 to control the shutting off of the light switch. In other words, the fluid responsive timing means is rendered ineffective and the light switch will remain on until the slider 44 is rotated in the opposite direction about point A to move the slider 44 out of the opening 34. Thereafter the slider 44 can be manually moved to the first or off position or set in the second position with the latch 76 engaging recess 80.

Figure 6:
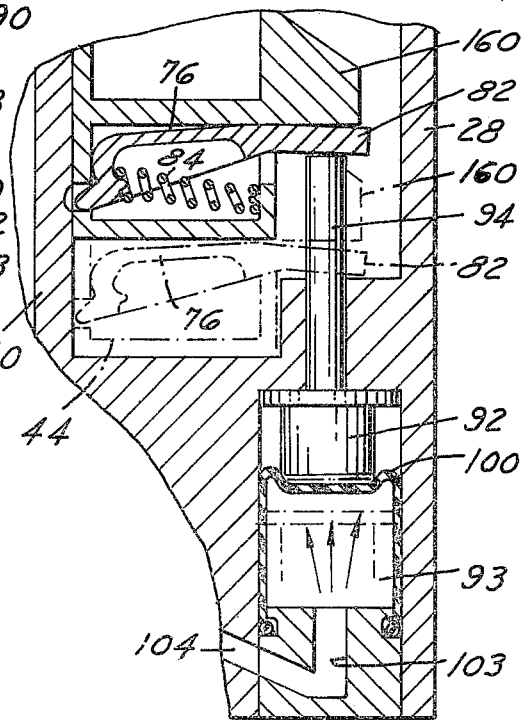
FIG. 6 is a fragmentary view in section illustrating the manner in which the fluid responsive piston and cylinder device releases the latch holding the trip slide.

Slider or trip slide 44 includes an operating lug 160 (FIGS. 3 and 6). The lug 160 is located entirely within the interior of the body 18 and it functions as a ram or drive element which engages end portion 82 of lever 76 when the latch 76 is released and the compressed spring 70 takes over. In other words, when the compressed spring 70 releases its energy, the slider 44 is moved downwardly whereby the lug 160 engages the lever 76 and in turn the piston rod 96 as shown in solid lines in FIG. 6. As a result of such action, the piston rod 94 and piston 92 are moved downwardly in the cylinder 93. The hydraulic fluid is moved out of the cylinder 93, across passages 103, 104, 128 and finally through the ports 130 and then across the check valve element 132 into the reservoir 108. At such time the piston 92 and diaphragm 100 are bottomed in the cylinder 93 and the latch 73 and slider 44 are in the position shown by the dotted lines in FIG. 6.

In operation, the timing device 10 may be used to automatically turn the toggle light switch arm 14 either on or off. As illustrated in the drawings, the timing device 10 is used to automatically turn the toggle switch actuating arm 14 to an off position from an on position. Thus, prior to the timing device 10 becoming charged or readied, it is necessary for a person to turn the toggle switch arm 14 on and this is accomplished by moving the arm or tab 62 of the slider 44 upwardly thereby tripping the toggle actuating arm 14. Thereafter, if not before, the user adjusts the variable valve means 106 thereby determining the rate of flow of fluid which will pass from reservoir 108 through the variable metered foam valve element or restrictor 131 to the cylinder 93 as a result of the compressed air forcing the hydraulic fluid through the metered valving. For a predetermined time interval, the hydraulic fluid from reservoir 108 is forced by the air pressure through the metered orifice 177, restrictor 131, passages 128, 104 and 103 into the cylinder 93 where the hydraulic fluid reacts against the diaphragm 100 resulting in a force moving the actuator or piston 92 and stem 94 upwardly. As a result thereof, the piston rod 94 trips the lever 76 and urges same in a direction whereby the detent 78 is pulled out of the recess 80 and works against the spring 84. Thereafter, the compressed spring means 70 drives the slider 74 from the position indicated in FIGS. 3 and 4 to the position indicated in FIG. 2 and by the dotted line position of FIG. 6.

Finally, it will be appreciated that after the slider 44 is manually set as in FIG. 4, with the spring 70 compressed and the latch 76 in recess 80, the compressed air from the reservoir 150 forces the highly viscous fluid 110 from the reservoir 108 through the metered orifice 117 and restrictor 131 to the diaphragm 100 provided in cylinder 93. As a result of the fluid passing into the cylinder 93, the hydraulic fluid reacts against the diaphragm 100 and transmits linear motion to the piston 92 and rod 94 to force them upwardly in the cylinder 93 as shown in FIG. 3. Once the piston 92 and stem 94 have moved upwardly to a predetermined position, the latch 76 is operated and released, with the detent 78 being withdrawn from the recess 80. At the time of latch release, the previously stored energy in the main spring 70 forces the slider 44 from the second position (FIG. 4) to the off position as shown in FIG. 2. This corresponds to what is described herein as the first position. This motion is effective to turn off the toggle wall switch or arm 14 and return the piston 92 to the start position near the bottom of cylinder 93.

At such time the piston 92 and diaphragm 100 are forced downwardly by the slider ram 160 which forces the hydraulic fluid trapped in the cylinder 93 out of the cylinder through passages 103, 104, 128 etc. and finally through ports 130 and from where the hydraulic fluid returns to the fluid reservoir 108. The system is now ready to repeat the function when the slider 44 is moved to the latched position.

When the slider or trip slide 44 is manually moved from its off or first position (FIG. 2) to its on position (FIG. 5), the reaction torque will rotate the slider 44 about point A and lock its leading or bottom edge against surface 155 of the main switch body 18 or in other words it will assume the position of FIG. 5 as discussed previously. This puts the toggle switch arm 14 in a normally on position and, as stated previously, the switch arm 14 will remain on until the slider 44 is pushed in the opposite direction or moved into the body away from surface 155. At such time the slider 44 will disengage itself from the surface 155 of the front wall 19. The latch 76 will then coincide with the recess 80 and the spring 84 will swing the latch 76 into engagement with the recess 80 thereby holding the slider 44 in place with the spring 70 compressed as illustrated in FIGS. 3 and 4.

The slider 44 can be released from this time or second position by an overriding manually applied force which can move it to the off or first position or can be returned to the off or first position by the time release described previously. The slider 44 can be released from the on or second position directly by application of a manual force to the slider 44 via knob or arm 62 which releases the lever or latch 76.

Opening and closing the needle valve 134 at the base of the main body 18 determines the amount of time delay provided in the closed hydraulic circuit or system.

The timing device 10 may be used to automatically turn the toggle light switch on rather than off as described herein. Also the timing device may be used with weapons or as part of any control system to operate or actuate an arm or device.

What is claimed is:

1. A timing device intended for operating an electrical toggle type wall switch having an operating arm projecting outwardly from a standard type electrical switch plate, said timing device comprising a body having a front wall provided with a first opening, a back wall provided with a second opening, and a peripheral wall connecting said front and back walls, internal wall means located in the interior of said body and defining a cavity, said timing device being adapted to overlie the switch plate, with said back wall in engagement with the switch plate and the outwardly projecting arm of the toggle switch extending into said cavity through said second opening provided in said back wall, a trip slide mounted in said cavity and movable in opposite directions between first and second limiting positions, said trip slide having means for receiving and engaging the outwardly projecting arm of the toggle switch for operating and tripping same as a result of the movement of said trip slide, spring means in said cavity engageable with said trip slide for urging same towards said first limiting position, said spring means being compressed by said trip slide when the latter is moved to said second limiting position, said trip slide including an arm portion projecting outwardly from said body through said first opening provided in said front wall and through which a force may be applied to the trip slide to move same relative to said spring means to one or the other of the limiting positions, a latch carried by said trip slide and engageable with said internal wall means to maintain the trip slide in said second limiting position with said spring means compressed, and fluid responsive timing means located within the interior of said body and engageable with said latch to operate and release said latch from engagement with said internal wall means after the expiration of a predetermined time interval thereby permitting said compressed spring means to move said trip slide to said first limiting position thus tripping the operating arm of said toggle switch.

2. The timing device as defined in claim 1 wherein resilient means are carried by said trip slide for biasing said latch towards latching engagement with said internal wall means.

3. The timing device as defined in claim 1 wherein said fluid responsive timing means includes a fluid actuator abutting said latch, a pressurized fluid reservoir, a fluid passage connecting said reservoir to said actuator, and adjustable valve means interposed in said passage between said reservoir and said actuator for controlling the rate of fluid flow from the reservoir to said fluid actuator for energizing same.

4. The timing device as defined in claim 3 wherein said fluid actuator is in the form of a piston-cylinder device with said piston having a rod at one side which engages said latch, and an expandable diaphragm engaging the other side of said piston and being subjected to the fluid entering said actuator so as to control the rate of movement of said piston and piston rod.

5. The timing device as defined in claim 3 wherein compressed air is provided in said body to pressurize said fluid reservoir.

6. The timing device as defined in claim 1 wherein said fluid responsive timing means comprises a closed hydraulic system located within said body having a pressurized hydraulic reservoir, an actuator for operating said latch, and adjustable valve means located between said reservoir and said actuator for controlling hydraulic flow between said actuator and said reservoir.

7. The timing device as defined in claim 6 wherein said valve means includes an adjustable valve element which controls the rate of fluid flow from said reservoir through an orifice into said actuator and a one-way check valve which opens when the hydraulic fluid is ejected from said actuator when said trip slide is moved to said first limiting position.

8. The timing device as defined in claim 7 wherein said adjustable valve element is made from a compressible open cell plastic foam material.

9. The timing device as defined in claim 1 wherein said fluid responsive timing means includes a hydraulic piston and cylinder device abutting said latch for operating same, a pressurized hydraulic reservoir, a passage connecting said reservoir to said cylinder, adjustable valve means located in said passage and including an orifice, an adjustable needle element movable toward and away from said orifice and a compressible open cell plastic valve element located between said orifice and said needle element for controlling the rate of hydraulic flow from said reservoir to said cylinder for operating said piston and in turn said latch.

10. The timing device as defined in claim 9 wherein said adjustable valve means includes a one-way check valve which permits the fluid from said cylinder to return to said reservoir when said trip slide is moved to said first limiting position.

11. The timing device as defined in claim 1 wherein said trip slide when in said second limiting position is rotatable in said body to a third position to bring a portion of said trip slide into engagement with a portion of the front wall which surrounds said first opening thereby rendering said fluid responsive timing means inoperative when said spring means is compressed and said trip slide is in said third position.

12. A timing device comprising a hollow body, internal wall means located in the interior of said body, a trip slide mounted in said body and movable in opposite directions along an axis between first and second positions, said trip slide having means adapted for receiving and engaging an operating arm for tripping same as a result of the movement of said trip slide, spring means in said body engageable with said trip slide for urging same towards said first position, said spring means being compressed by said trip slide when the latter is moved to said second position, a latch carried by said trip slide and engageable with said internal wall means to maintain the trip slide in said second position with said spring means compressed, and fluid responsive timing means located within the interior of said body and engageable with said latch to operate and release said latch from engagement with said internal wall means after the expiration of a predetermined time interval thereby permitting said compressed spring means to move said trip slide to said first position thus tripping the operating arm.

13. The timing device as defined in claim 12 wherein said body includes an abutment at one side of and spaced from said axis and said trip slide, means mounting said trip slide in said body for rotation in a direction perpendicular to said axis from said second position to a third position where said spring means remains compressed and said trip slide engages said abutment, the engagement of said slide and said abutment overriding the effectiveness of said fluid responsive timing means and preventing same from controlling said trip slide.

14. The timing device as defined in claim 13 wherein resilient means are carried by said trip slide for biasing said latch towards latching engagement with said internal wall means.

15. The timing device as defined in claim 13 wherein said fluid responsive timing means includes a fluid actuator abutting said latch, a pressurized fluid reservoir, a fluid passage connecting said reservoir to said actuator, and adjustable valve means interposed in said passage between said reservoir and said actuator for controlling the rate of fluid flow from the reservoir to said fluid actuator for energizing same.

16. The timing device as defined in claim 15 wherein said fluid actuator is in the form of a piston-cylinder device, with said piston having a rod at one side which engages said latch, and an expandable diaphragm engaging the other side of said piston and being subjected to the fluid entering said actuator so as to control the rate of movement of said piston and piston rod.

17. The timing device as defined in claim 15 wherein compressed air is provided in said body to pressurize said fluid reservoir.

18. The timing device as defined in claim 13 wherein said fluid responsive timing means comprises a closed hydraulic system located within said body having a pressurized hydraulic reservoir, an actuator for operating said latch, and adjustable valve means located between said reservoir and said actuator for controlling hydraulic flow between said actuator and said reservoir.

19. The timing device as defined in claim 18 wherein said valve means includes an adjustable valve element which controls the rate of fluid flow from said reservoir through an orifice into said actuator and a one-way check valve which opens when the hydraulic fluid is ejected from said actuator when said trip slide is moved to said first position by said spring means.

20. The timing device as defined in claim 19 wherein said adjustable valve element is made from a compressible open cell plastic foam material.

21. The timing device as defined in claim 13 wherein said fluid responsive timing means includes a hydraulic piston and cylinder device abutting said latch for operating same, a pressurized hydraulic reservoir, a passage connecting said reservoir to said cylinder, adjustable valve means located in said passage and including an orifice, an adjustable needle element movable toward and away from said orifice and a compressible open cell plastic valve element located between said orifice and said needle element for controlling the rate of hydraulic flow from said reservoir to said cylinder for operating said piston and in turn said latch.

22. The timing device as defined in claim 21 wherein said adjustable valve means includes a one-way check valve permits the fluid from said cylinder to return to said reservoir when said trip slide is moved to said first position by said spring means.

23. A timing device comprising a hollow body having a front wall provided with a first opening, a back wall provided with a second opening, and a peripheral wall connecting said front and back walls, internal wall means located in the interior of said body, a trip slide mounted in said body and movable in opposite directions along an axis between first and second positions, said trip slide having means adapted for receiving and engaging an operating arm for tripping same as a result of the movement of said trip slide, spring means in said body engageable with said trip slide for urging same towards said first position, said spring means being compressed by said trip slide when the latter is moved to said second position, means mounting said trip slide in said body for rotation from said second position to a third position and in a direction perpendicular to said axis, with said spring means remaining compressed whereby upon rotation a part of said trip slide extends into said first opening and engages said front wall to lock same in said third position, said trip slide including an arm portion projecting outwardly from said body through said first opening provided in said front wall and through which a force may be applied to the trip slide to move same relative to said spring means to one or the other of said positions, a latch carried by said trip slide and engageable with said internal wall means to maintain the trip slide in said second position with said spring means compressed, and fluid responsive timing means located within the interior of said body and engageable with said latch to operate and release said latch from engagement with said internal wall means after the expiration of a predetermined time interval thereby permitting said compressed spring means to move said trip slide to said first position thus tripping the operating arm.

* * * * *